US005975525A

United States Patent [19]

Hartmann et al.

[11] Patent Number: 5,975,525

[45] Date of Patent: Nov. 2, 1999

[54] PADDLE WHEEL FOR LAYING OUT FOLDED PRODUCTS

[75] Inventors: Manfred Wolfgang Hartmann, Elfershausen; Horst Bernhard Michalik, Höchberg, both of Germany

[73] Assignee: Koenig & Bauer-Albert Aktiengesellschaft, Wurzburg, Germany

[21] Appl. No.: 08/981,500

[22] PCT Filed: Jul. 4, 1996

[86] PCT No.: PCT/DE96/01203

§ 371 Date: Jan. 9, 1998

§ 102(e) Date: Jan. 9, 1998

[87] PCT Pub. No.: WO97/03010

PCT Pub. Date: Jan. 30, 1997

[30] Foreign Application Priority Data

Jul. 11, 1995 [DE] Germany ..... 195 25 168

[51] Int. Cl.[6] ..... B65H 29/20

[52] U.S. Cl. ..... 271/315; 270/39.09; 270/60

[58] Field of Search ..... 271/315, 314; 270/39.09, 60

[56] References Cited

U.S. PATENT DOCUMENTS

| | | | |
|---|---|---|---|
| 2,026,162 | 12/1935 | De Manna . | |
| 4,052,053 | 10/1977 | Hasegawa | 271/315 |
| 4,058,202 | 11/1977 | Reist et al. . | |
| 4,522,387 | 6/1985 | Leuthold . | |
| 4,537,390 | 8/1985 | Kiamco et al. . | |
| 4,638,993 | 1/1987 | Granzow et al. | 271/315 |
| 4,925,173 | 5/1990 | Linblom et al. | 270/60 |
| 5,026,036 | 6/1991 | Takahashi | 271/315 |
| 5,065,997 | 11/1991 | Butts et al. . | |
| 5,112,033 | 5/1992 | Breton . | |
| 5,639,083 | 6/1997 | Doucet | 271/315 |

FOREIGN PATENT DOCUMENTS

| | | | |
|---|---|---|---|
| 0 104 383 | 4/1984 | European Pat. Off. . | |
| 0 164 440 | 12/1985 | European Pat. Off. . | |
| 0 644 142 | 3/1995 | European Pat. Off. . | |
| 26 04 101 | 10/1985 | Germany . | |
| 41 07 235 | 11/1991 | Germany . | |
| 4242885 | 6/1994 | Germany | 271/315 |

*Primary Examiner*—William E. Terrell
*Assistant Examiner*—Khoi H. Tran
*Attorney, Agent, or Firm*—Jones, Tullar & Cooper, P.C.

[57] ABSTRACT

A paddle wheel is used to deliver folded products to a conveyor belt in a shingled fashion. The paddle wheel has a plurality of pockets which are formed by circumferentially spaced curved paddles. The thickness or width of each product receiving product is adjustable by providing a guide strip in each pocket. The end of the guide strip adjacent the bottom of each pocket can be shifted radially with respect to the axis of rotation of each paddle wheel by actuation of a drive assembly.

12 Claims, 3 Drawing Sheets

PADDLE WHEEL FOR LAYING OUT FOLDED PRODUCTS

FIELD OF THE INVENTION

The present invention relates to a paddle wheel for delivering folded products in a scale-like or shingled flow or orientation.

DESCRIPTION OF THE PRIOR ART

A device for receiving printed products from a folding apparatus and for delivering them to a conveyor belt is known from EP 0 164 440 B1. In this prior art device the printed products are received between two paddles of several paddle wheels, which paddle wheels are spaced at a distance from each other in the axial direction. For braking an incoming printed product, a pre-stressed lever arm is hingedly fixed in place on the hub of the device in the vicinity of the bottom of a paddle wheel pocket located between two paddles.

However, it is disadvantageous in connection with this device that, because of their low mass, thin printed products in particular are difficult to insert between the lever arm and the paddle, which results in irregularities in the alignment of products placed on the delivery belt.

A device for stacking sheet-shaped objects is known from EP 0 104 383 B1, wherein at least one of the several identical paddle wheel disks, which are spaced apart from each other, is turned with respect to the other paddle wheel disks in such a way that the spaces between the paddle wheel pockets of the various paddle wheel disks are no longer aligned with each other. Because of this the front edge of the sheet-shaped objects in particular is made wavy and is therefore clamped. However, this can only be accomplished in connection with thin products, wherein these thin products are possibly permanently deformed in an undesirable manner at their front edge.

In accordance with another embodiment of the above mentioned EP 0 104 383 B1, the paddle wheel pockets of at least one paddle wheel disk have elastic boundary walls which utilize, for example leaf springs, for clamping the products on the front. In this case, the same as in connection with EP 0 164 440 B1, it is disadvantageous that, in particular because of their low mass, it is difficult to guide thin products in a gap between the pre-stressed leaf spring and a paddle, or respectively to deliver them in the correct position. It is not possible by use of this device to correctly deliver products of variable thickness.

SUMMARY OF THE INVENTION

It is the object of the present invention to create a paddle wheel for delivering folded products.

This object is attained in accordance with the invention by utilization of a paddle wheel for the delivery of folded products in which the paddles, which cooperate to form product receiving pockets, are slightly curved and overlap one another. A leaf-spring-like guide strip is situated at the outside of each pocket. A first end of each such guide strip is secured to the paddle lip and a second end of each guide strip ends in the vicinity of the pocket bottom. This second end of each guide strip can be moved radially with respect to the paddle wheel to effectively vary the width or thickness of the inner end of the product receiving product. An actuating assembly is provided to vary the radail location of the inner or second end of each guide strip.

The advantages which can be achieved by the present invention in particular reside in that the width or thickness of the opening of the paddle wheel pockets in the vicinity of the bottom of the paddle wheel pockets can be automatically adjusted. This bottom or inner pocket width thus can be matched to the thickness of the folded product to be delivered. Because of this, a width, or respectively a breadth, of the pocket bottom, which is always matched to the folded product, or respectively to the machine rpm, is set, so that a positionally correct transfer, or deposit, of folded products can take place in every case. A taper of the gap between the paddle and the guide strip prevents the folded products from snapping back or rebounding after reaching the paddle wheel pocket bottom. After their front edges have met the paddle bottom, the kinetic energy of thin folded products in particular can be reduced in a directed manner in that the rear half of the folded product is deformed in wavy lines because of contact with the paddle wheel pocket between the paddle and the guide strip, which widens in the direction toward the paddle tip, and thereafter again takes on its elongated position. The paddle wheel pockets are suitable for securely receiving, as for well as positionally correctly depositing thick and thin folded products.

BRIEF DESCRIPTION OF THE DRAWINGS

An exemplary embodiment of present the invention is represented in the drawings and will be described in detail in what follows.

Shown are in

DESCRIPTION OF THE PREFERRED EMBODIMENT

Figure 1:
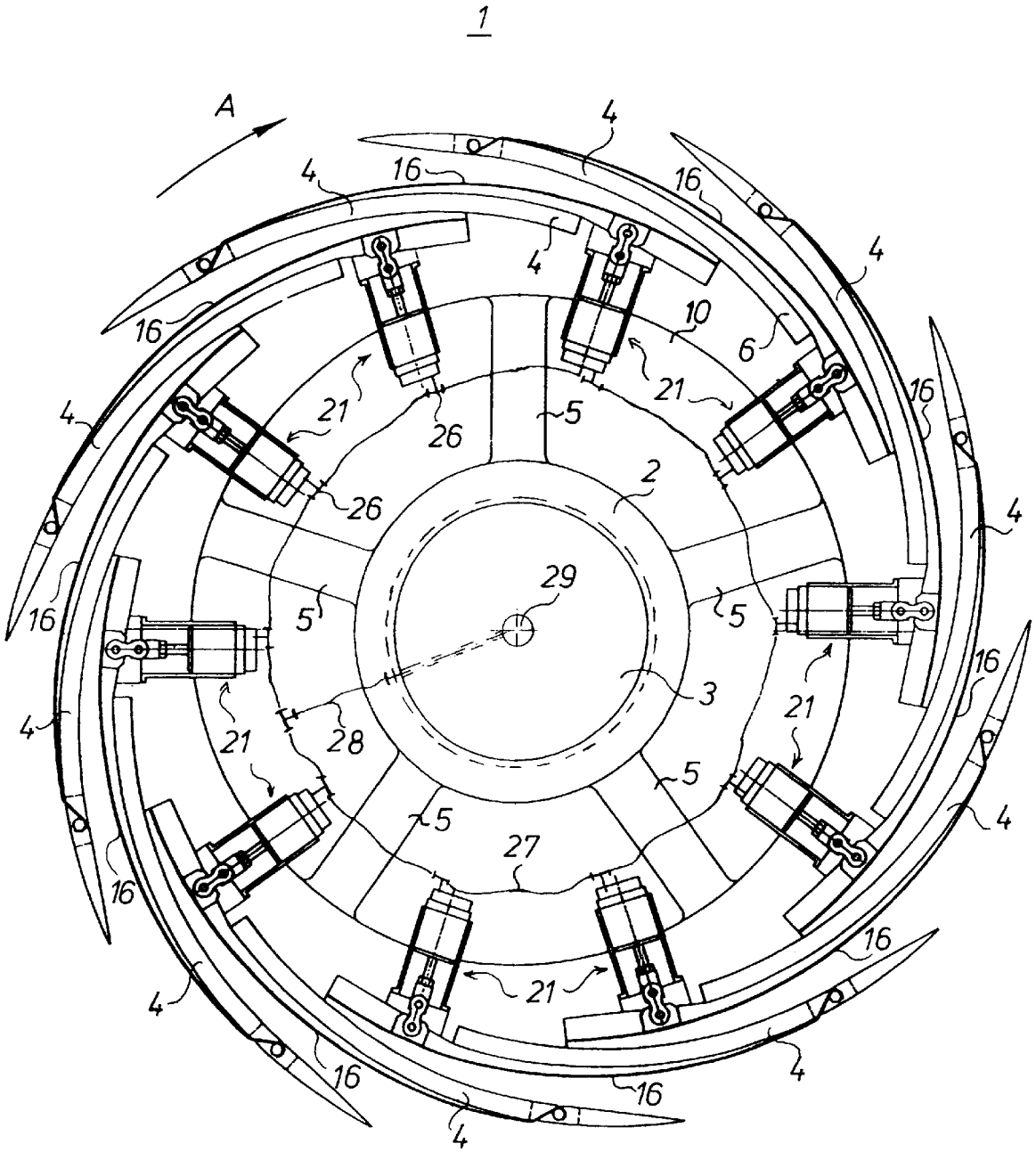
FIG. 1, a schematic representation of a cross section of a paddle wheel with a device in accordance with the present invention.

The hub 2 of a paddle wheel 1 is arranged, fixed against relative rotation, on a drive shaft 3 that is seated fixed in place in lateral frames, as seen in FIG. 1. The hub 2 has radially outward oriented spokes 5, which support an annular paddle holder 10 at their ends. On its outer circumference, the paddle holder 10 receives curved paddles 4, extending approximately in the tangential direction, whose paddle inner ends 6 are interlockingly connected with the paddle holder 10. The same parts numbers will be used for like parts throughout this description. The paddles 4 overlap each other wherein, viewed in the clockwise rotational direction A, a paddle wheel pocket 11, which tapers inwardly or which reduces in width or thickness in the direction toward the pocket bottom 9, is respectively formed between the outside or outer surface 7, of paddle 4 i.e. the side of a paddle 4 remote from the hub, and the inside or inner surface 8, of paddle 4 i.e. the side of a preceding paddle 4 close to the hub. The pocket bottom 9 is formed by the outer circumference of the paddle holder 10 and an inside 8 of a paddle 4. An opening or aperture 13, for example of rectangular shape, is located in the vicinity of the outer tip 12 of each paddle 4. A first end or outer 14 of a guide strip 16 is pivotably fastened, or seated in aperture 13. The guide strip 16 extends along the outside or outer surface 7, i.e. the surface of each paddle 4 that is remote from the hub or facing away from the hub 2 of the paddle wheel 1, in the direction toward the pocket bottom 9 and ends with its second or inner end 17 before the pocket bottom 9, i.e. in the vicinity of the pocket bottom 9, without touching it. The guide strip 16 can consist of spring steel, has approximately the width of the paddle 4 and, in the state of rest, its second or inner end 17 rests against the inside paddle surface close to the hub of the adjoining paddle 4, so that the width "b" of the pocket bottom 9 approaches zero. Each guide strip 16 is hingedly connected with an operating member of an actuating means, for example with the piston rod 19 of a pneumatic short-stroke cylinder 21, as seen most clearly in FIG. 2. This connection is accomplished at an inside surface 18 of guide strip 16 close to the hub 2 as well as in the vicinity of the second or inner end 17 of the leaf-spring-like guide strip 16. In this way, the guide strip 16 is arranged so it can be raised and lowered in the radial direction "c" of the paddle wheel 1 at its second or inner end 17 in the vicinity of the pocket bottom 9 by means of a drive or actuating means, for example by the piston rod 19. Each one of the short-stroke cylinders 21 respectively connected with the inner surface 18 of the guide strip 16 is located in a bore 22 in the paddle holder 10 and extending in the radial direction "c" in respect to the hub 2, so that the direction of stroke C of the piston rod 19 of the short-stroke cylinder 21 also extends in the radial direction "c" of the hub 2, or respectively of the paddle wheel 1. The free end of the piston rod 19 is connected with the guide strip 16 by means of a hinged strap 23, for example in the form of a chain link. The first or outer end 14 of the guide strip 16 is angled and is designed to be semicircular, so that the end 14 extends beneath a bolt 24, which extends in the opening 13 in a direction axis-parallel with the drive shaft 3, and a bearing is formed in this way all as may be seen in FIGS. 1 and 2.

Figure 2:
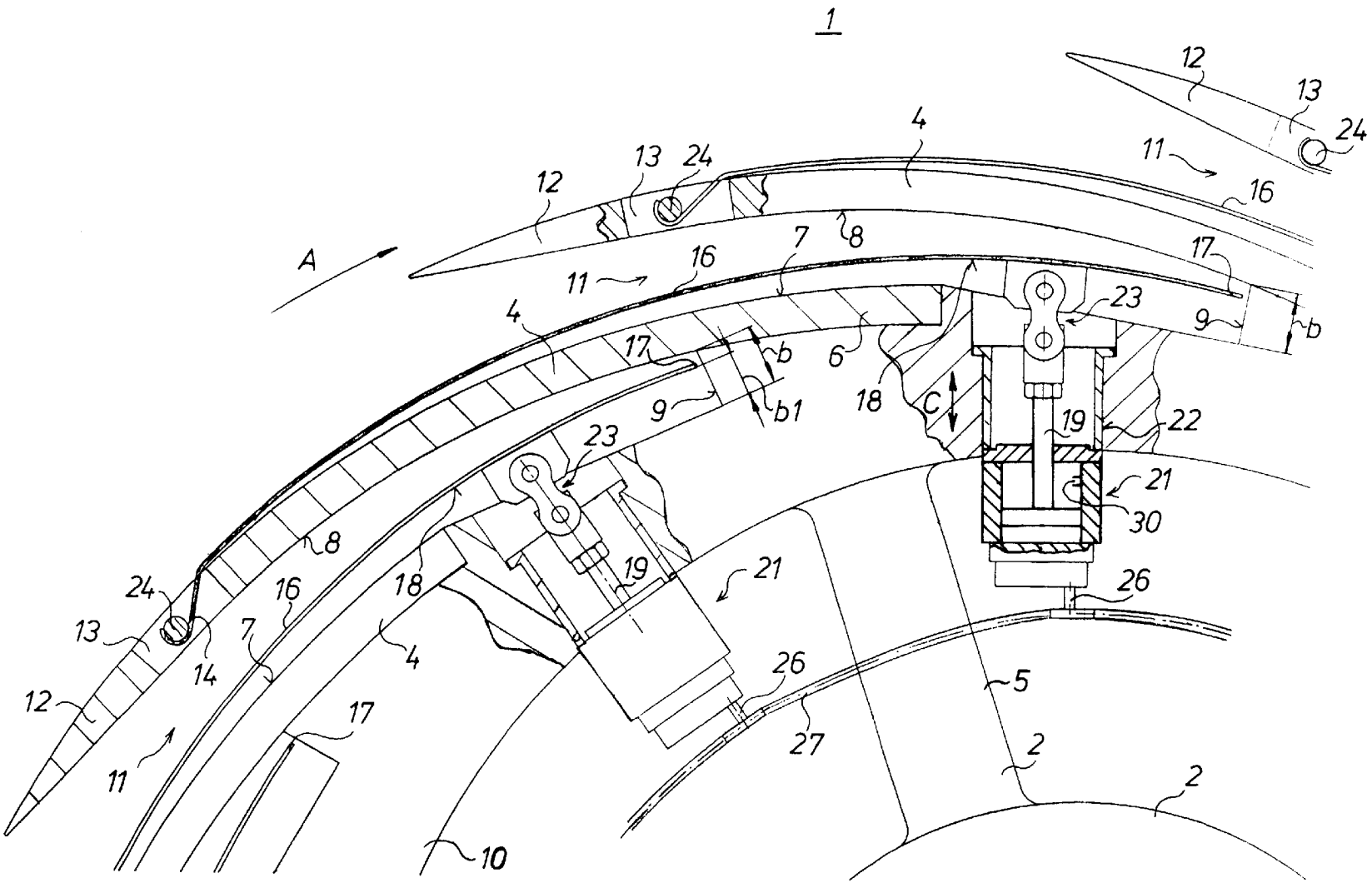
FIG. 2, an enlarged portion of the paddle wheel depicted in FIG. 1; and in FIG. 3, an outline wiring diagram for accomplishing the automatic setting of the width of a pocket bottom of a paddle wheel pocket for receiving a folded product.
Figure 3:
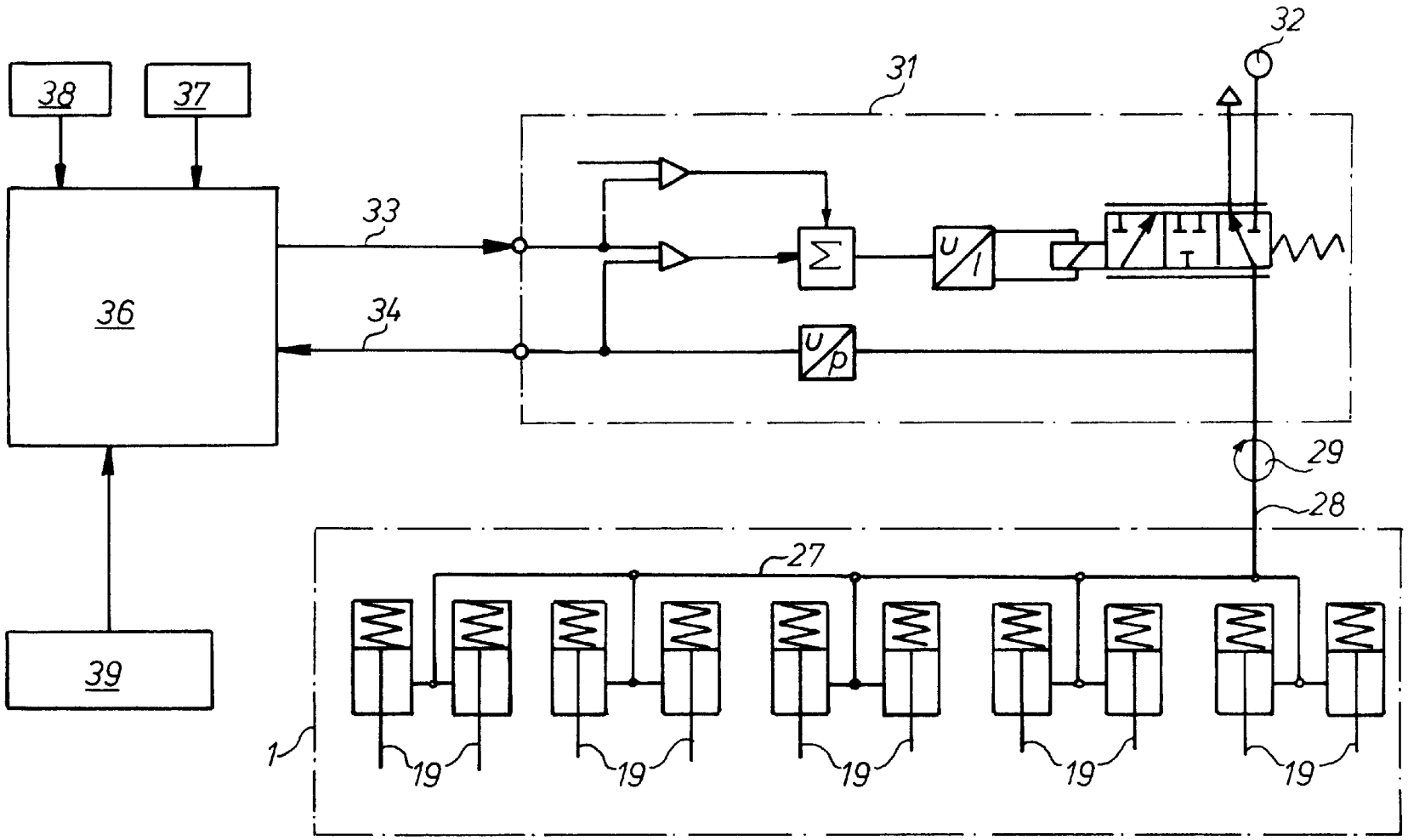

All of the short-stroke cylinders 21 each have a connector 26 for compressed air, which connector 26 is connected with a circular line 27 which, in turn, is connected via a supply line 28 with a bore of an axle journal of the drive shaft 3. In this case, the supply of compressed air for the short-stroke cylinder 21 extends from the connector 26 to an inflow opening 30, from where it flows into the part of the short-stroke cylinder 21 near the piston rod. A known rotary connector 29 for compressed air, as indicated in FIGS. 1 and 2, is located on the axle journal. The rotary connector 29 is supplied with compressed air from a central compressed air supply 32 via a known pressure-control valve 31, as depicted in FIG. 3, wherein the pressure-control valve 31 is connected by means of electrical lines 33, 34 with a presetting computer 36, for example a PC. The presetting computer 36 is furthermore also connected with an rpm counter 37 located at the drive of the paddle wheel 1, for example a tachometer generator, as well as with a folded product thickness measuring device 38, known from DE 38 38 314 A1. The presetting computer 36 is furthermore connected with a keyboard 39.

Several paddle wheels 1, not specifically represented, are spaced axially apart from each other, and are arranged on the drive shaft 3. The paddle wheel pockets 11 of each paddle wheel receive folded products coming from a folding blade cylinder, not represented, or from a wheel folding unit. The thickness of the folded products to be conveyed varies between four and 160 newspaper pages and, with tabloid products, between eight and 160 pages. In order to assure a trouble-free reception of these folded products in the paddle wheel pockets 11, and a trouble-free delivery of the folded products out of the paddle wheel pockets, the width "b" of the pocket bottom 9 of the paddle wheel pockets 11 can be set and fixed as described below. The air pressure for operating the short-stroke cylinders 21 is determined by the compater 36 as a function of the thickness of the folded products to be transported by the paddle wheels 1, and as a function of the rpm of the paddle wheels 1 and a width "b" is set, for example, of the pocket bottom 9 in the radial direction "c" of the paddle wheel 1, as seen most clearly in FIG. 2. The rpm-dependent value is required for compensating the centrifugal force of the guide strips 16. The input of data regarding the folded product can be performed by means of the keyboard 39.

However, if there is no presetting computer 36 nor a folded products thickness measuring device 38, it is also possible to set the air pressure manually by means of a precision regulating valve at a central operating device, so that the width "b" of the pocket bottom 9 can also be adjusted in this way.

It is furthermore possible to utilize a generally conventional adjusting spindle motor in place of a short-stroke cylinder for adjusting the position of the inner second or inner end 17 of the guide strip 16. The adjusting spindle motor respectively comprises a stator fixed in place on the paddle holder 10 and a rotor fixed in place on the adjusting spindle. In that case, the adjusting spindle respectively acts on the second or inner end 17 of the guide strip 16, wherein the spindle position is reported by a linear potentiometer. Current lines can be provided via the axle journal, for example by means of collector rings.

Finally, it is also possible to adjust the second or inner end 17 of the guide strip 16 by means of a cam acting as a regulating means, and which is fixedly connected with a planetary wheel. A sun wheel of the size of the hub, which can be driven independently of the paddle wheel 1 and which can be rotatably seated on the paddle wheel 1, meshes with planetary wheels located at its circumference, wherein a planetary wheel with a cam is associated with each guide strip 16.

While a detailed description of the preferred embodiment of a paddle wheel for laying out folded products, in accordance with the present invention, has been set forth fully and completely hereinabove, it will be apparent to one of skill in the art that a number of changes in, for example, the type of printing press with which the paddle wheel is associated, the type of folded product removal device, the material being printed and the like could be made without departing from the true spirit and scope of the present invention which is accordingly to be limited only by the following claims.

What is claimed is:

1. A device for the delivery of folded products comprising:

a paddle wheel having a circumferential surface;

a plurality of paddles, each of said paddles having a paddle outer tip, a paddle inner end, and spaced paddle inner and outer surfaces, each of said paddle inner ends being secured to said paddle wheel circumferential surface, said plurality of paddles overlapping each other and forming a plurality of circumferentially spaced folded product receiving pockets, each of said pockets having a pocket bottom;

a plurality of guide strips each having an outer end and an inner end, said outer end of each of said guide strips being secured to said paddle outer tip of a corresponding one of said plurality of paddles, each said guide strip extending along said corresponding paddle to which it is secured, each said guide strip inner end terminating adjacent said pocket bottom formed by said paddle to which said guide strip is secured and an adjacent one of said plurality of paddles; and actuating means for shifting said inner end of each of said guide strips in said associated pocket bottom radially with respect to said paddle wheel.

2. The device of claim 1 wherein said paddle wheel is rotatable about a central hub and further wherein each of said guide strips is secured on said outer surface of its associated paddle.

3. The device of claim 1 wherein each said guide strip and each said associated paddle have the same width.

4. The device of claim 1 wherein each said guide strip is spring steel.

5. The device of claim 1 wherein said actuating means includes a pneumatic, short-stroke cylinder.

6. The device of claim 1 further including a presetting computer for controlling said actuating means, and a folded product thickness measuring device, said folded product thickness measuring device being connected to said presetting computer.

7. The device of claim 6 further including an rpm counter, said rpm counter being connected to said presetting computer.

8. The device of claim 5 further including a pressure control valve for supplying a pressure fluid to said actuating means.

9. The device of claim 8 further including a presetting computer for controlling said pressure control valve.

10. The device of claim 8 further including a central compressed air supply connected to said pressure control valve.

11. The device of claim 1 wherein said actuating means includes an adjusting spindle and an adjusting spindle drive motor.

12. The device of claim 1 wherein said actuating means includes a planetary gear and a cam connected to said planetary gear for each of said guide strips, and further including a sun wheel secured to said paddle wheel and in gear mesh engagement with each said planetary gear.

* * * * *